US008474625B2

(12) United States Patent
Denzler

(10) Patent No.: US 8,474,625 B2
(45) Date of Patent: Jul. 2, 2013

(54) BLISTER PACKAGING FOR SANITARY INSERT PARTS OR ACCESSORY PARTS

(75) Inventor: Oliver Denzler, Bottmingen (DE)

(73) Assignee: Neoperl GmbH, Mullheim (DE)

( * ) Notice: Subject to any disclaimer, the term of this patent is extended or adjusted under 35 U.S.C. 154(b) by 0 days.

(21) Appl. No.: 13/576,223

(22) PCT Filed: Dec. 9, 2010

(86) PCT No.: PCT/EP2010/007506

§ 371 (c)(1),
(2), (4) Date: Jul. 31, 2012

(87) PCT Pub. No.: WO2011/095190

PCT Pub. Date: Aug. 11, 2011

(65) Prior Publication Data

US 2012/0298545 A1 Nov. 29, 2012

(30) Foreign Application Priority Data

Feb. 2, 2010 (DE) ..... 10 2010 006 510

(51) Int. Cl.
*B65D 73/00* (2006.01)

(52) U.S. Cl.
USPC ..... 206/576; 206/469; 229/92.8

(58) Field of Classification Search
USPC .. 206/461, 467, 469, 531, 534, 576; 229/92.8
See application file for complete search history.

(56) References Cited

U.S. PATENT DOCUMENTS

| | | | | |
|---|---|---|---|---|
| 3,414,414 | A * | 12/1968 | Christine et al. | 426/122 |
| 3,841,475 | A | 10/1974 | Ellis | |
| 3,970,194 | A * | 7/1976 | Iten | 206/228 |
| 4,430,843 | A * | 2/1984 | Favale | 53/410 |
| 4,854,450 | A * | 8/1989 | Fisher | 206/469 |
| 5,203,455 | A * | 4/1993 | Hewelt et al. | 206/704 |
| 6,269,158 | B1 * | 7/2001 | Kim | 379/144.01 |
| 2003/0150902 | A1 * | 8/2003 | Huff et al. | 229/92.8 |
| 2007/0278280 | A1 * | 12/2007 | Wert et al. | 229/80 |

FOREIGN PATENT DOCUMENTS

| | | |
|---|---|---|
| CA | 2436335 | 1/2005 |
| EP | 0755874 | 1/1997 |
| EP | 1108413 | 6/2001 |

* cited by examiner

*Primary Examiner* — Jacob K Ackun
(74) *Attorney, Agent, or Firm* — Volpe and Koenig, P.C.

(57) ABSTRACT

A blister packaging (3) for sanitary insert parts or accessory parts (4, 5, 6). The sanitary insert or accessory parts (4, 5, 6) can be interchanged with each other or combined with each other. Each of the sanitary insert parts or accessory parts (4, 5, 6) is arranged in a mold cavity (8) of a molded plastic-film part (7) made from transparent plastic. Because the insert parts or accessory parts (4, 5, 6) that can be interchanged with each other or combined with each other are accommodated in a single blister packaging (3), the correct association of these parts (4, 5, 6) is ensured and the handling of these parts (4, 5, 6) is made easier even for the uninformed user. Because insert parts that can be combined with each other if necessary can also be packaged with each other in the blister packaging (3) according to the invention, the parts (4, 5, 6) initially not required to assemble the desired parts combination can be stored in the blister packaging (3) in a protected manner and in such a way that these parts can be easily found again.

6 Claims, 3 Drawing Sheets

BLISTER PACKAGING FOR SANITARY INSERT PARTS OR ACCESSORY PARTS

BACKGROUND

The invention relates to a blister packaging for at least two articles which are packaged therein and are arranged in each case in a molded cavity of a plastic film molded part which is manufactured from transparent plastic, the blister packaging being configured as a press-out packaging and, to this end, its plastic film molded part being connected to a cardboard rear wall which can be inscribed and closes the molded cavities of the plastic film molded part, through which cardboard rear wall the articles which are packaged in the blister packaging can be pressed out of the molded cavity which is assigned to them.

Blister packages which are also called blister packs are already known in a very wide variety of embodiments. In the previously known blister packages, a product which is also intended as an insert or accessory part is usually packaged visibly. To this end, the previously known blister packages have a plastic film molded part which is manufactured from transparent plastic film and supports the product to be packaged in a molded cavity which is made in the plastic film.

CA 2 436 335 A1 has previously disclosed a blister packaging which is configured as a blister pack which is child-proof but which can be handled easily by older users. The previously known blister packaging has a plastic film molded part which is manufactured from transparent plastic and has a corresponding number of molded cavities in order to package at least two articles. Since the previously known blister packaging is provided as a press-out packaging, its plastic film molded part is connected to an inscribable cardboard rear wall, through which the articles which are packaged in the blister packaging can be pressed out of that molded cavity of the plastic film molded part which is assigned to them. In order for it to be possible to weaken the cardboard rear wall in the region of the molded cavities in such a way that, although the relevant molded cavity initially remains closed, it can be pressed through more easily, the molded cavities are assigned adhesive stripes on the rear side of the cardboard rear wall, which adhesive stripes, when they are pulled off, pull off at least one layer of the cardboard rear wall. Capsules, tablets or other objects are usually provided as articles which can be packaged in the previously known blister packaging.

U.S. Pat. No. 3,841,475 A has previously disclosed a blister packaging which is provided for receiving a bobbin pair of a sewing machine intended for the needle thread and bobbin thread. To this end, the previously known blister packaging has a plastic film molded part which has two differently dimensioned molded cavities, the shapes of which are adapted to the different dimensions of the two bobbins of a bobbin pair.

EP 0 755 874 A1 has previously disclosed a blister packaging which is configured in the form of a postcard. On one of its flat sides, the previously known blister packaging has a molded cavity which is manufactured from transparent material and in which an article can be packaged in such a way that, upon visual inspection of the previously known blister packaging, the attention of the observer is drawn immediately to the article which is packaged therein. On its flat side which faces away from the molded cavity, the previously known blister packaging has a franking and address panel which is intended for sticking on a stamp and for inscribing with the delivery address of the recipient.

Blister packages of this type allow the customer or purchaser to see the packaged article. Here, the product is presented in front of a cardboard wall and is fixed with the plastic film molded part. It is often considered to be disadvantageous that the blister packaging usually becomes unusable after being opened for the first time and must be disposed of as packaging waste.

In the case of insert or accessory parts of this type which can optionally be exchanged for one another or combined with one another, expert knowledge is frequently required in order for it to be possible for the insert or accessory parts which are situated in the individual blister packages to be assigned relevantly to one another.

SUMMARY

It is therefore the object to provide a blister packaging for articles which are assigned to one another and are intended for sanitary use; the blister packaging according to the invention is intended to substantially facilitates the handling of the packaged products by the vendor and/or customer.

The achievement according to the invention of this object consists, in particular, of the fact that the packaged articles are configured as sanitary insert or accessory parts which can optionally be exchanged for one another or combined with one another, that the cardboard rear wall bears a product-describing inscription which is configured as an operating and/or installation guide which is printed onto the cardboard rear wall for the packaged sanitary insert or accessory parts, and that the blister packaging is configured as a postcard-like shipping packaging and the cardboard rear wall has, on an outer visible side, an address panel which can be labeled, inscribed or printed.

The blister packaging according to the invention is intended for at least two sanitary insert or accessory parts which can optionally be exchanged for one another or optionally can be combined with one another if required. Since said insert or accessory parts which can be exchanged for one another or combined with one another are accommodated in a single blister packaging, the correct assignment of said parts is ensured and the handling of said parts is also facilitated for the unpracticed or uninformed user. Since insert or accessory parts of the type which can optionally be combined with one another if required can be packaged with one another in the blister packaging according to the invention, those parts which are not required for the time being in order to assemble the desired part combination can be stored in the blister packaging according to the invention such that they are protected and can be found again readily. Installation and/or operating instructions which are required, for example, for the relevant assembly of the individually required part combination are also printed easily and undetachably on the blister packaging according to the invention, as a result of which the handling of the blister packaging according to the invention and of the insert or accessory parts which are packaged therein is also additionally facilitated. Since the molded cavities of the plastic film molded part which is used for the blister packaging according to the invention are closed by means of an inscribable cardboard rear wall, the cardboard rear wall can be provided particularly simply with a readily legible print or can also be inscribed in a handwritten manner if required. Since the blister packaging according to the invention is configured as a press-out packaging, the plastic film molded part of which is connected to a cardboard rear wall, through which cardboard rear wall the articles which are packaged in the blister packaging are pressed out of the molded cavity which is assigned to them, the required part or the parts which are required for a certain part combination can be removed simply and without relatively great effort from the blister packaging according to the invention, the blister packaging being available without relatively great damage, for example, for referring to the operating or installation guide printed thereon and/or for the well protected storage of the parts which are not required for the time being. It is likewise possible to store the replaced part in the film cavity which has become free or to store the original part in its original place again in the blister packaging in the case of it being exchanged again later for a further insert or accessory part.

Since the cardboard rear wall of the blister packaging according to the invention has, on an outer visible side, an address panel which can be labeled, inscribed or printed, the blister packaging according to the invention can serve as a postcard-like shipping packaging which is delivered, for example, as bulk mail or as a mailshot to the intended recipients for further use.

The articles to be packaged can be packaged in a well protected manner in the blister packaging according to the invention, and the parts which are not required for the time being can also be stored if required over a relatively long time period in a well protected manner in the blister packaging according to the invention, if the plastic film molded part is configured as a welded packaging and/or if the molded cavities of the plastic film molded part are closed by means of at least one film rear wall.

To this end, one preferred embodiment according to the invention proposes that the plastic film molded part is connected to an inscribable cardboard wall. A cardboard wall of this type can be provided particularly simply with a readily legible print or else can also be inscribed in a handwritten manner if required.

It is advantageous if the plastic film molded part and/or the cardboard wall bear/bears a product-describing inscription, and if an operating and/or installation guide for the packaged sanitary accessory parts is printed, in particular, onto the cardboard wall.

The articles to be packaged can be packaged in a well protected manner in the blister packaging according to the invention, and the parts which are not required for the time being can also be stored if required over a relatively long time period in a well protected manner in the blister packaging according to the invention, if the plastic film molded part is configured as a welded packaging and/or if the molded cavities of the plastic film molded part are closed by means of at least one film rear wall.

A further proposal for achieving the object set above which has its own protectable significance and can also be used advantageously in the case of a blister packaging which is intended only for one sanitary insert or accessory part provides that the plastic film molded part is configured as a press-out packaging, and/or that the packaged sanitary accessory parts can be pressed out individually from the molded cavity which is assigned to them through a film rear wall. If the plastic film molded part is configured as a press-out packaging or if the insert or accessory parts which are packaged in the blister packaging according to the invention can be pressed individually out of the molded cavity which is assigned to them through a film rear wall, the required part or the parts which are required for a specific part combination can be removed simply and without relatively great effort from the blister packaging according to the invention, the blister packaging being available without relatively great damage, for example, for referring to the operating or installation guide printed thereon and/or for the well protected storage of the parts which are not required for the time being. It is likewise possible to store the replaced part in the film cavity which has become free or to store the original part in its original place again in the blister packaging in the case of it being exchanged again later for a further insert or accessory part.

It is advantageous if the cardboard rear wall also has, on its visible side which has the address panel, a franking panel.

It is particularly advantageous if the cardboard rear wall is configured as a single-piece material blank. An embodiment of this type, in which the cardboard rear wall is configured as a single-piece material blank, can be manufactured particularly easily and inexpensively.

It can be advantageous if the cardboard rear wall has at least two cardboard wall part regions which are connected integrally to one another via a fold and can be folded over one another. Although the cardboard wall part regions which are connected integrally to one another make a large inscribable area available, said cardboard wall part regions can be folded over one another in a space-saving manner such that the blister packaging according to the invention only then has comparatively small outer dimensions.

In order for it to be possible for the insert or accessory parts which are situated in the plastic film molded part of the blister packaging according to the invention to be stored, shipped or packaged in some other way in a well protected manner, it is advantageous if the plastic film molded part is arranged between two cardboard wall part regions of the cardboard wall in a protected manner in the folded up state of the blister packaging.

Developments according to the invention result from the following description in conjunction with the drawing.

BRIEF DESCRIPTION OF THE DRAWINGS

In the following text, the invention will be described in even greater detail using preferred exemplary embodiments.

In the drawings.

DETAILED DESCRIPTION OF THE PREFERRED EMBODIMENTS

Figure 1:
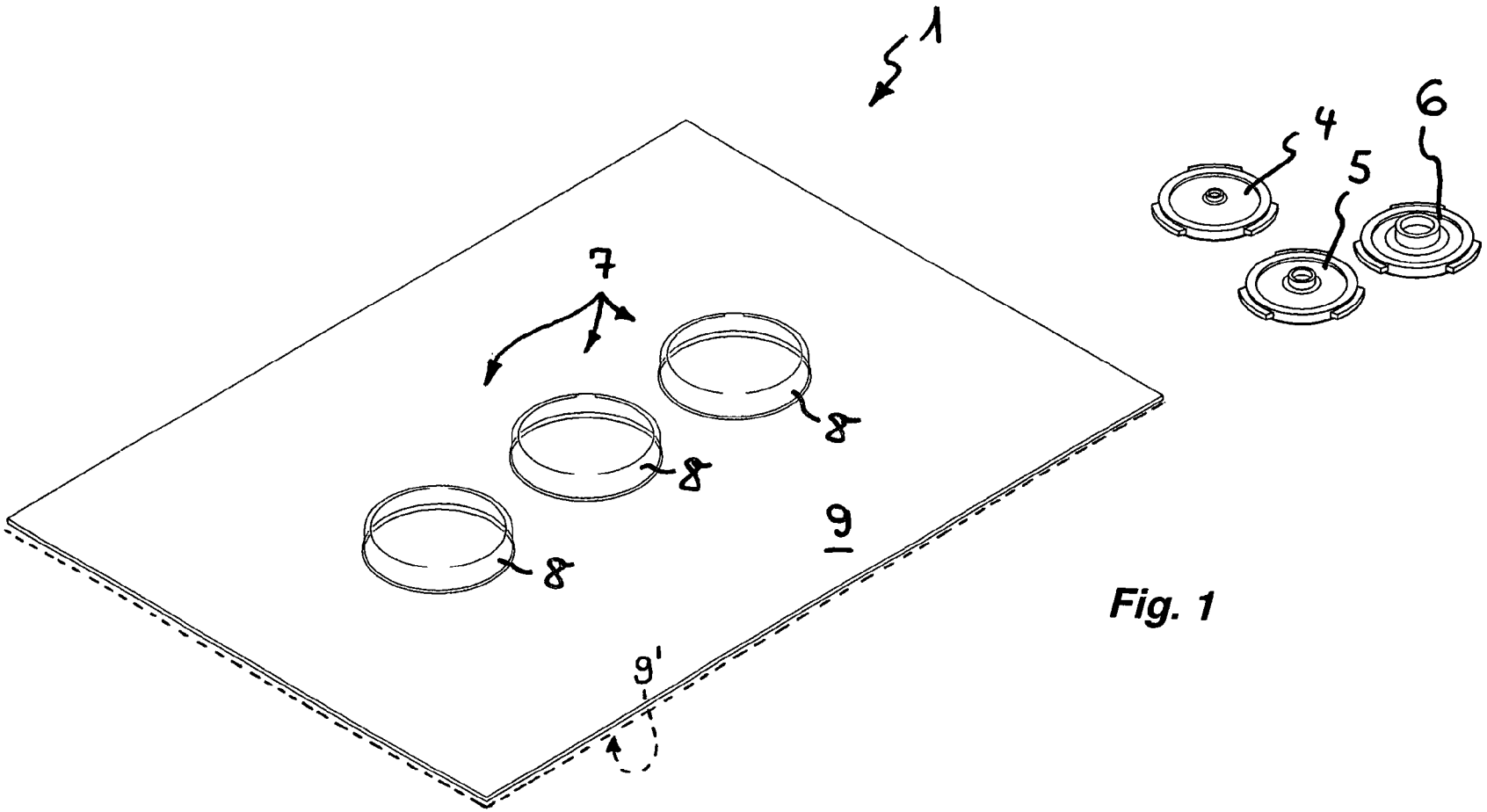
FIG. 1 shows a blister packaging which is depicted in a perspective illustration, with a plastic film molded part which is manufactured from transparent plastic and bears three molded cavities which are intended to receive in each case one sanitary insert or accessory part.
Figure 2:
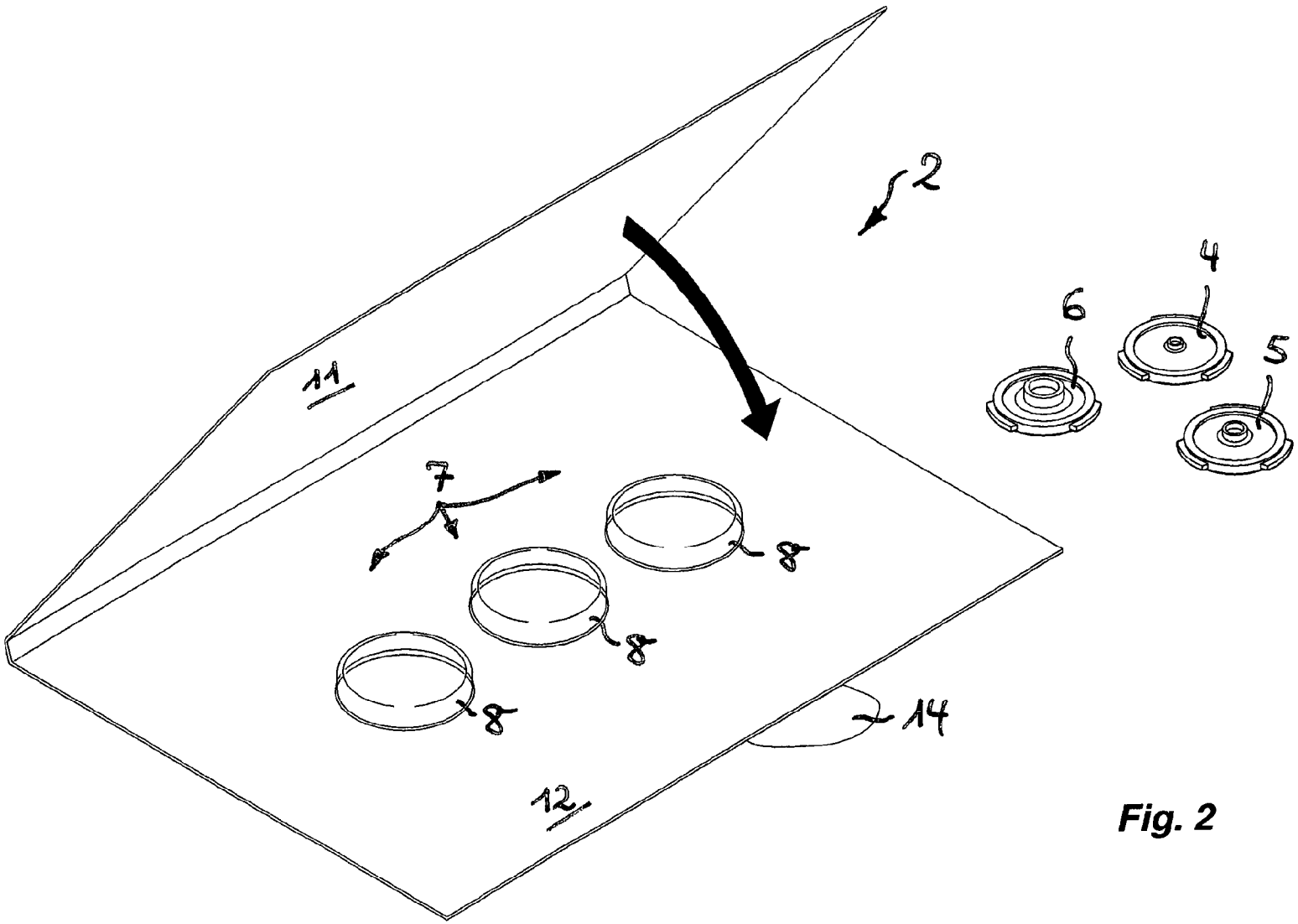
FIG. 2 shows a blister packaging which is comparable with FIG. 1 and in which the plastic film molded part is connected to a cardboard wall which has two cardboard wall part regions which are connected integrally to one another via a fold and can be folded over one another.
Figure 3:
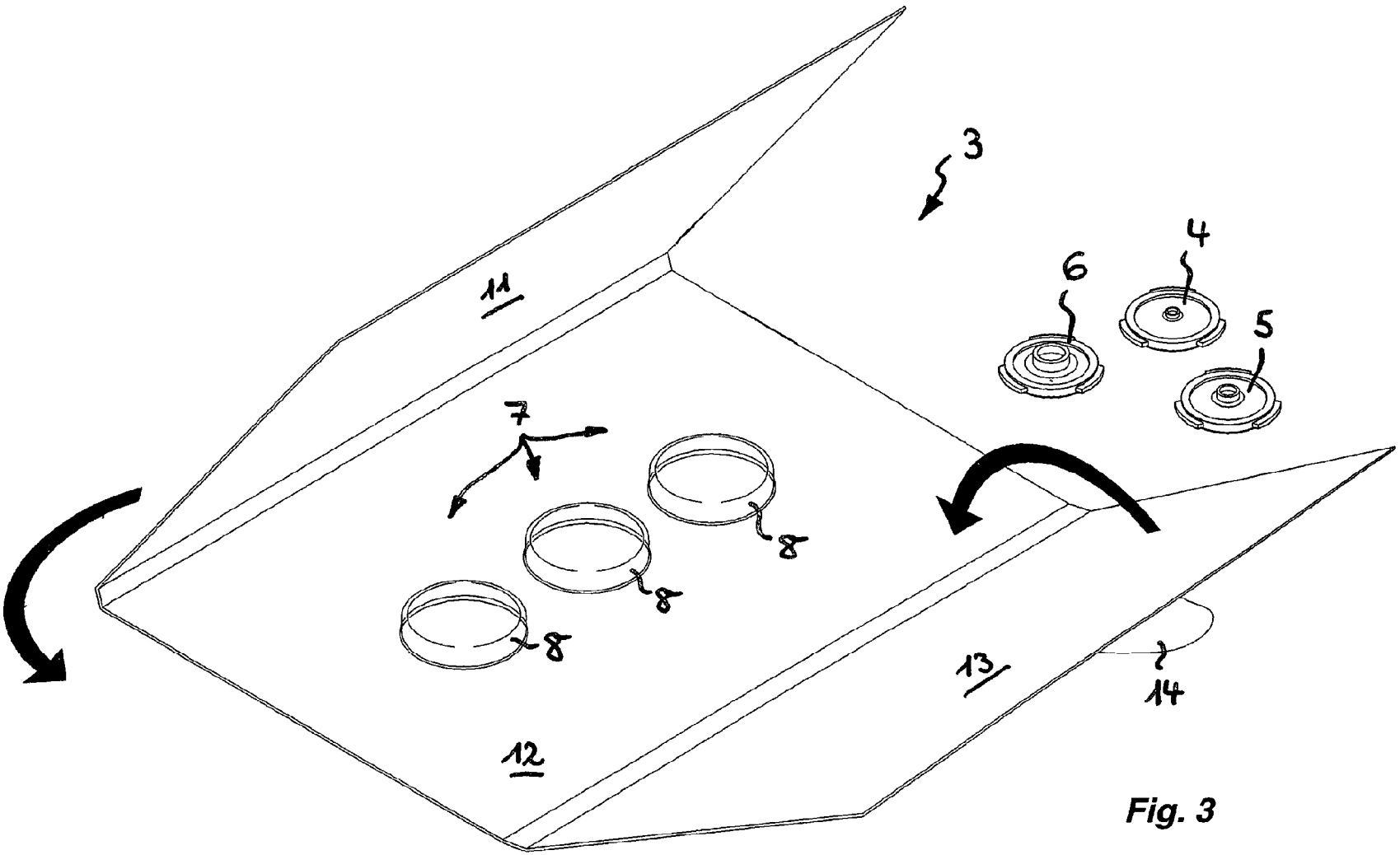
FIG. 3 shows a blister packaging which is comparable with FIGS. 1 and 2 and in which the cardboard wall has three cardboard wall part regions which are connected integrally to one another via a fold and can be folded over one another in such a way that the plastic film molded part is arranged between two cardboard wall part regions of the cardboard wall in a protected manner in the folded up state of the blister packaging.

FIGS. 1 to 3 show three different embodiments 1, 2, 3 of a blister packaging or blister pack which are intended to receive at least one insert or accessory part and preferably at least two sanitary insert or accessory parts. Here, the blister packages 1, 2, 3 which are shown here are intended to receive at least two and preferably three continuous flow controllers 4, 5, 6 which can be inserted, for example, into a sanitary hose connection of a shower hose or a sanitary hose line of this type and are intended to fix the water consumption there to a maximum value per unit time, independently of the water pressure.

The blister packages 1, 2, 3 have a plastic film molded part 7 which is manufactured from a transparent plastic film. The plastic film molded part 7 has at least one molded cavity 8 and, in this case, three molded cavities 8 which are intended to receive in each case one of the insert or accessory parts 4, 5, 6.

The insert or accessory parts which are packaged in the blister packages 1, 2, 3 shown here can optionally be combined with one another and/or can optionally be exchanged for one another. Since said insert or accessory parts 4, 5, 6 which can be exchanged for one another or combined with one another are accommodated in a single blister packaging, the correct assignment of said parts is ensured and the handling of said parts is also facilitated for the unpracticed or uninformed user. Since insert or accessory parts which can optionally be combined with one another if required can also be packaged with one another in the blister packages 1, 2, 3, the insert or accessory parts which are not required for the time being in order to assemble the desired part combination can be stored in the blister packaging 1, 2 or 3 such that they are protected and can be found again easily. Installation and/or operating instructions or other product-describing specifications which are required, for example, for the relevant assembly of the individually required parts can also be printed easily and undetachably on the blister packages 1, 2 or 3, as a result of which the handling of the blister packages 1, 2, 3 and of the insert and accessory parts 4, 5, 6 which are packaged therein is also additionally facilitated.

Three continuous flow controllers 4, 5, 6 are packaged in the blister packages 1, 2, 3 according to FIGS. 1 to 3, which continuous flow controllers 4, 5, 6, although they can optionally be exchanged for one another, at the same time differ from one another as a result of different throughflow rates. On the basis of the installation and operating instructions which are situated on the blister packages 1, 2, 3, the uninformed user can also determine the throughflow rate which is required by him individually and can subsequently select and remove the continuous flow controllers which are required for this purpose from the blister packaging 1, 2, 3, whereas the continuous flow controllers 4, 5 or 6 which are not required for the time being remain in the blister packaging 1, 2, 3 for now. The continuous flow controllers 4, 5, or 6 which are not required for the time being are available in the blister packaging 1, 2, 3 for a later use in such a manner that they can be found easily.

The plastic film molded part 7 is connected to an inscribable cardboard wall 9. The molded cavities 8 are preferably provided in the single-piece plastic film molded part 7. However, it is also possible that separate part regions of the plastic film molded part 7 which bear at least one molded cavity 8 are connected to one another via the cardboard wall 9. Here, the cardboard wall 9 has three round stamped-out portions or cutouts, through which in each case one molded cavity 8 projects in a cup-shaped manner, whereas the remaining part region of the plastic film molded part 7 bears on the rear side of the cardboard wall 9 such that it cannot be seen or, as is shown in FIG. 1 in a multiple-layer embodiment which is shown as an alternative by dashed lines, is provided between the cardboard wall 9 and the cardboard wall 9'.

Although the plastic film molded part 7 can also bear a product-describing inscription, the embodiments 1, 2, 3 which are shown here are preferred, in which an inscription which is not shown here in further detail, for example operating and/or installation tips, for the packed sanitary accessory parts 4, 5, 6 is printed onto the cardboard wall 9.

In order that the insert or accessory parts 4, 5, 6 remain in those molded cavities 8 of the plastic film molded part 7 which are assigned to them, the plastic film molded part is configured as a welded or adhesively bonded packaging. To this end, the molded cavities 8 of the plastic film molded part 7 are closed by means of at least one film or preferably perforated cardboard rear wall which cannot be seen in further detail here.

Here, one embodiment, in which the plastic film molded part 7 is configured as a press-out packaging is preferred. To this end, the sanitary insert or accessory parts 4, 5, 6 which are packaged in the blister packages 1, 2, 3 can be pressed individually out of the molded cavity 8 which is assigned to them through a film or preferably perforated cardboard rear wall.

As becomes clear from a comparison of firstly FIG. 1 and secondly FIGS. 2 and 3, the blister packages 2, 3 which are shown in FIGS. 2 and 3 have at least two cardboard wall part regions which are connected integrally to one another via a fold 10 and can be folded over one another. Whereas the blister packaging 2 according to FIG. 2 has two cardboard wall part regions 11, 12 which can be folded over one another, in contrast three cardboard wall part regions 11, 12 and 13 which are connected integrally to one another are provided in the case of the blister packaging 3 in FIG. 3. The cardboard wall 9 also of the blister packages 2, 3 are manufactured from a single-piece material blank.

Here, the blister packages 1, 2, 3 which are shown in FIGS. 1 to 3 are configured as a postcard-like shipping packaging. To this end, an address panel which can also preferably be written on manually or by printing and/or can be inscribed and/or can be labeled and optionally a franking panel are provided on an outer visible side of the cardboard wall 9. In order for it to be possible for the insert or accessory parts which are packaged in the plastic film molded part 7 to be accommodated in a captive and protected manner in the molded cavities, the plastic film molded part 7 of the blister packaging 3 is arranged between two cardboard wall part sections 11 and 13 of the cardboard wall 9 in the folded up state of said blister packaging 3.

The invention claimed is:

1. A blister packaging (1, 2, 3) and at least two articles which are packaged therein, the blister packaging comprising a plastic film molded part (7) with a molded cavity for receiving each of the articles which is manufactured from transparent plastic, the blister packaging (1, 2, 3) being configured as a press-out packaging and the plastic film molded part (7) being connected to a cardboard rear wall (9) which can be inscribed and closes the molded cavities (8) of the plastic film molded part (7), and through said cardboard rear wall (9) the articles which are packaged in the blister packaging (1, 2, 3) can be pressed out of the molded cavity (8) which is assigned to them, the packaged articles are flow controllers (4, 5, 6) having different flow rates which can optionally be exchanged for one another, the cardboard rear wall (9) bears a product-describing inscription which is configured as at least one of an operating or installation guide which is printed onto the cardboard rear wall (9) for the flow controllers (4, 5, 6), and the blister packaging (1, 2, 3) is configured as a shipping packaging having a compact size for postal delivery, and the cardboard rear wall (9) has, on an outer visible side, an address panel which can be labeled, inscribed or printed.

2. The blister packaging as claimed in claim 1, wherein the plastic film molded part (7) is a welded or adhesively bonded packaging.

3. The blister packaging as claimed in claim 1, wherein the cardboard rear wall (9) also has, on the outer visible side which has the address panel, a franking panel.

4. The blister packaging as claimed in claim 1, wherein the cardboard rear wall (9) is a single-piece material blank.

5. The blister packaging as claimed in claim 1, wherein the cardboard rear wall (9) has at least two cardboard wall part regions (11, 12, 13) which are connected integrally to one another via a fold (10) and can be folded over one another.

6. The blister packaging as claimed in claim 5, wherein the plastic film molded part (7) is arranged between the two cardboard wall part regions (11, 13) of the cardboard rear wall (9) in the folded up state of the blister packaging (3).

* * * * *